US007784641B2

(12) United States Patent
Chou

(10) Patent No.: US 7,784,641 B2
(45) Date of Patent: Aug. 31, 2010

(54) BEVERAGE CUP LID WITH A PULL BACK TYPE SIPPING HOLE CLOSURE

(76) Inventor: Shin-Jai Chou, 3 Fl., No. 17, Pao Ching Street, Hsintien City, Taipei Hsien (TW)

( * ) Notice: Subject to any disclaimer, the term of this patent is extended or adjusted under 35 U.S.C. 154(b) by 639 days.

(21) Appl. No.: 11/730,593

(22) Filed: Apr. 3, 2007

(65) Prior Publication Data

US 2008/0245792 A1 Oct. 9, 2008

(51) Int. Cl.
*B65D 43/16* (2006.01)
*B65D 51/18* (2006.01)

(52) U.S. Cl. ..... 220/832; 220/254.3

(58) Field of Classification Search ..... None
See application file for complete search history.

(56) References Cited

U.S. PATENT DOCUMENTS

| | | | | | |
|---|---|---|---|---|---|
| 2,276,577 | A | * | 3/1942 | Hahn | 229/123.3 |
| 3,364,937 | A | * | 1/1968 | Amaro | 131/257 |
| 3,442,416 | A | * | 5/1969 | Nicholson | 220/269 |
| 3,447,710 | A | * | 6/1969 | Blair | 215/254 |
| 3,730,380 | A | * | 5/1973 | Silver | 220/269 |
| 4,138,033 | A | * | 2/1979 | Payne et al. | 220/254.3 |
| 4,738,373 | A | * | 4/1988 | DeParales | 220/254.3 |
| 4,949,865 | A | * | 8/1990 | Turner | 220/713 |
| 5,090,584 | A | * | 2/1992 | Roberts et al. | 220/712 |
| 5,183,172 | A | * | 2/1993 | Boller | 220/270 |
| 5,335,812 | A | * | 8/1994 | Boller | 220/709 |
| 5,490,609 | A | * | 2/1996 | Lane et al. | 220/712 |
| 5,699,927 | A | * | 12/1997 | Lane et al. | 220/254.3 |
| 5,769,253 | A | * | 6/1998 | Gross | 215/237 |
| 5,839,601 | A | * | 11/1998 | Van Melle | 220/712 |
| 5,893,489 | A | * | 4/1999 | Giarrante | 222/482 |
| 6,089,397 | A | * | 7/2000 | Van Melle | 220/270 |
| 6,612,456 | B1 | * | 9/2003 | Hundley et al. | 220/254.3 |

* cited by examiner

*Primary Examiner*—Anthony Stashick
*Assistant Examiner*—Robert J Hicks
(74) *Attorney, Agent, or Firm*—Rosenberg, Klein & Lee

(57) ABSTRACT

A beverage cup lid with a pull back type sipping hole includes a tab that is disposed at a predetermined position of a sipping hole. The tab has a substantially ∩-shaped perforated portion extending from the top rim of a wall side to the center of a top side and a turnover portion formed after pulling off the ∩-shaped perforated portion. A raised inclined plane is extended from the external side to the center. A straight rib is formed at the external side of the turnover portion beyond the ∩-shaped perforated portion in such a manner that the turnover portion may be swiveled forward and downward at 270° and engaged in place, thereby forming a double layered structure on the wall side.

3 Claims, 6 Drawing Sheets

BEVERAGE CUP LID WITH A PULL BACK TYPE SIPPING HOLE CLOSURE

BACKGROUND OF THE INVENTION

1. Field of the Invention

The present invention relates to a cup lid structure, and more particularly to a beverage cup lid having a tab that when swiveled forward and downward at 270° exposes a sipping hole of the lid.

2. Description of the Related Art

The conventional cups used by food restaurants, coffee shops, convenience stores, etc. for containing hot beverages like hot coffee, hot cocoa, hot milk tea and the like have a corresponding cup lid. The cup lid normally has a perforated portion at one end thereof. In drinking the hot beverage within the cup, the perforated portion must be swiveled or ripped off. However, the swiveled perforated portion can be polluted by the dust in the air. Meanwhile, the removed perforated portion like a ring fastener of a pop-top can will more or less contaminate our environment. To buy a hot beverage and sip it in a car is often seen in the modern life. However, the beverage contained within the above-mentioned beverage cup can be sprayed everywhere in the car in case of an emergency stop or a sudden jolt. This may annoy the drinker very much.

As a result, a perforated portion after being swiveled still remains on the cup lid is disclosed by, for example, U.S. Pat. No. 4,738,373, titled "CUP COVER HAVING OPENING MEANS". According thereto, a cover 10 has a hinged tab 11 defined by score lines which is re-closable.

As shown in FIG. 2, U.S. Pat. No. 5,490,609 discloses a cup lid 20 having a tab 21. After pulling the tab 21 upward, a protrusion 22 is engaged into a cavity 23 on the top of the cup lid 20.

As shown in FIGS. 3 and 4, U.S. Pat. No. 6,089,397 teaches a cup lid 30 having a pull portion 31 that when pulled up is attached to the cup lid 30. A protrusion 32 atop the pull portion 31 can be engaged in an opposite direction into a cavity 33 in place.

As shown in FIGS. 5 and 6, U.S. Pat. No. 6,612,456 teaches a cup lid 40 having a lift type sipping portion 41. Unlike the previous disclosures, the sipping portion 41 includes a raised member 42. In exposing the hole, the lip compresses the raised member 42 downward such that it is removed from the sipping portion 41. Thereafter, it can be pulled backward to be fixed within a cavity 43.

Such structure includes U.S. Pat. Nos. 5,839,601, 4,949,865, 5,090,584, 5,699,927, 5,335,812 and 5,183,172. The pull portion for exposing the sipping hole is designed in such a manner that it is pulled upward then fixed in place at a back side. However, it is impractical for the finger to complete the above-mentioned action. In exposing the sipping hole, the beverage can be spattered on users by accident. Moreover, the lip can be scalded by the high temperature of the sipping portion in sipping the hot beverage like hot coffee since the one-layered structure is good for heat conduction. In addition, the pull portion is moved backward to be fixed at the center of the cup lid. Thus, it is easy for the nose in contact to the pull portion. Accordingly, the conventional lid cup requires further improvements.

SUMMARY OF THE INVENTION

It is a primary object of the invention to provide a cup lid having a tab that is swivelable forward and downward at 270°. Meanwhile, the tab can be fixed at the periphery of the cup lid by a locking mechanism. Thus, it allows the finger an easy manipulation with little effort. Besides, the beverage is not easily spattered to the user.

Another object of the present invention is to provide a beverage cup lid having a tab just in contact with the lower lip of the drinker when forward and backward moved to be fixed, thereby forming a double-layered structure. In this way, the action of the heat conduction on the sipping hole can be lessened for protecting the lip from scald on the lip caused by the action of the hot beverage.

A further object of the present invention is to provide a beverage cup lid having a tab that is not required to be thrown away but attached to the cup lid. Meanwhile, the tab can be swiveled upward and brought back to the original position in a sealed state. In this way, a thermal insulation is ensured. In addition, the structure may prevent the dust from falling into the cup. Furthermore, the beverage won't be spattered out when placed in a car or held in the hand in walking.

In order to achieve the above-mentioned objects, a cup lid in accordance with the invention includes a tab that is disposed at a predetermined position of a sipping hole. The tab has a ∩-shaped perforated portion extending from the top rim of a wall side to the center of a top side and a turnover portion formed after pulling off the ∩-shaped perforated portion. A raised inclined plane is extended from the external side to the center. A straight rib is formed at the external side of the turnover portion beyond the ∩-shaped perforated portion in such a manner that the turnover portion may be swiveled forward and downward at 270° and engaged in place, thereby forming a double layered structure on the wall side.

BRIEF DESCRIPTION OF THE FIGURES

The accomplishment of this and other objects of the invention will become apparent from the following descriptions and its accompanying figures of which.

DETAILED DESCRIPTION OF THE PREFERRED EMBODIMENT

Figure 1:
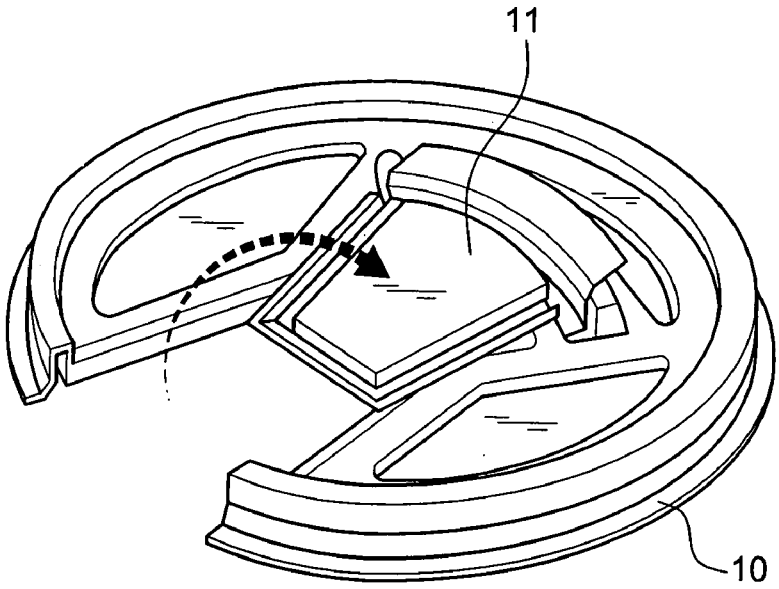
FIG.1 PRIOR ART
FIG. 1 is a perspective view of a cup lid disclosed in U.S. Pat. No. 4,738,373.
Figure 2:
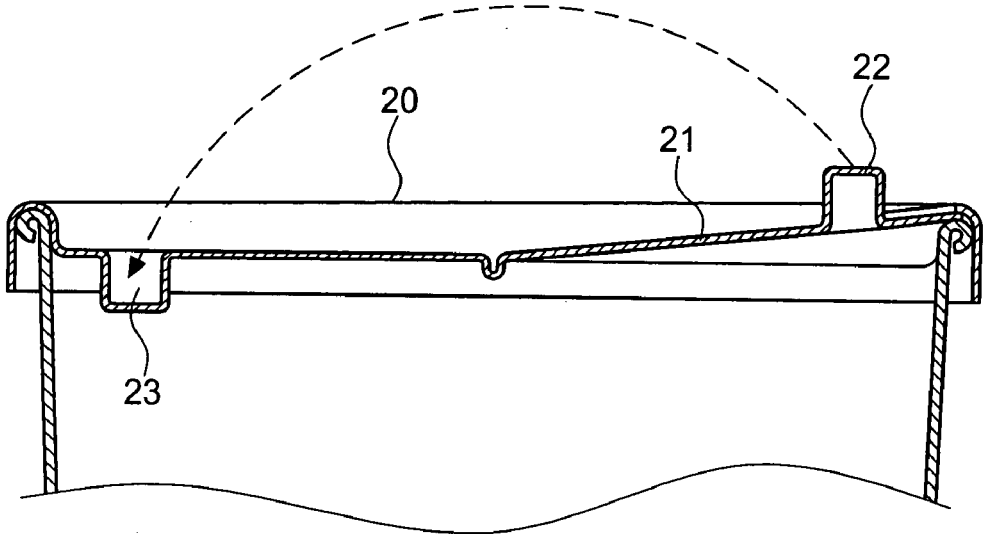
FIG.2 PRIOR ART
FIG. 2 is a cutaway view of a cup lid disclosed in U.S. Pat. No. 5,490,609.
Figure 3:
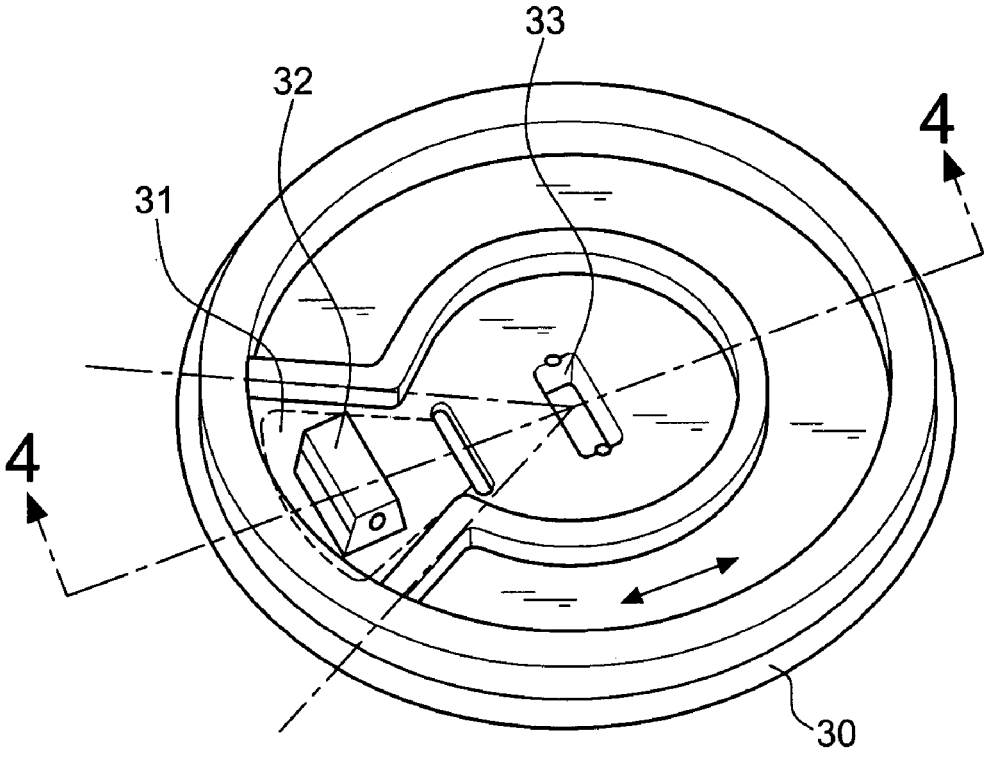
FIG.3 PRIOR ART
FIG. 3 is a cutaway view of a cup lid disclosed in U.S. Pat. No. 6,089,397.
Figure 4:
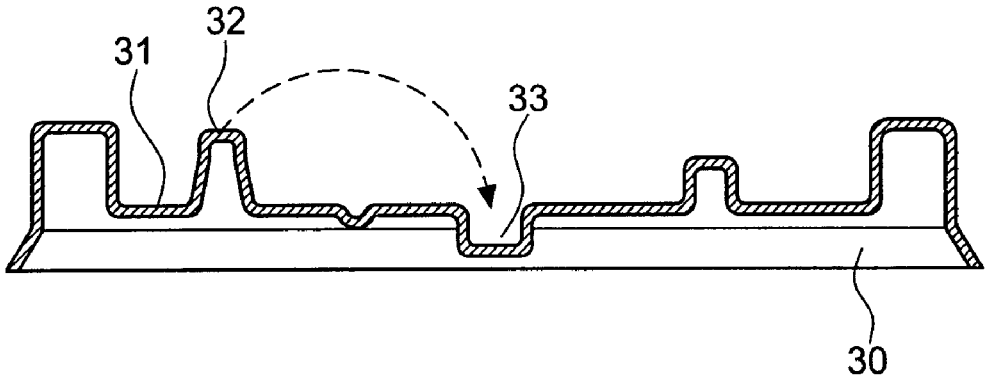
FIG.4 PRIOR ART
FIG. 4 is a cutaway view taken along the line 4-4 in FIG. 3.
Figure 5:
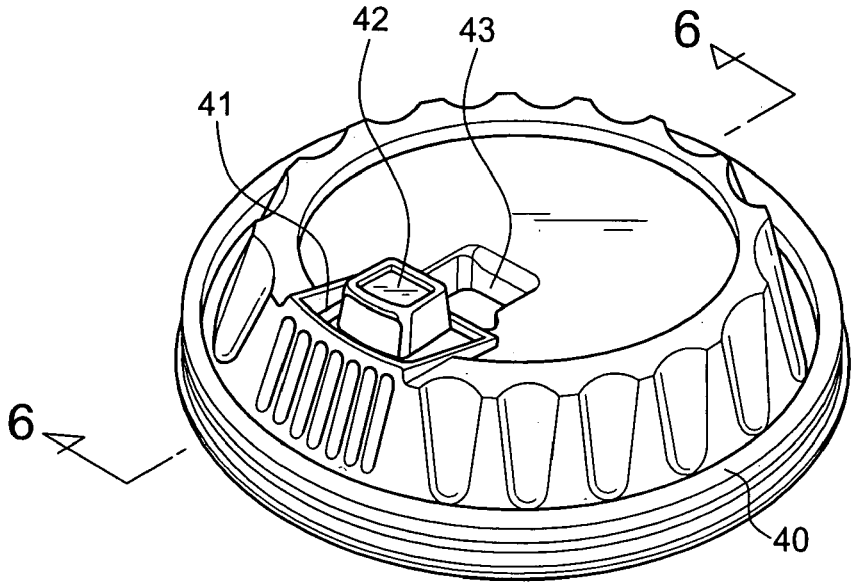
FIG.5 PRIOR ART
FIG. 5 is a perspective view of a cup lid disclosed in U.S. Pat. No. 6,612,456.
Figure 6:
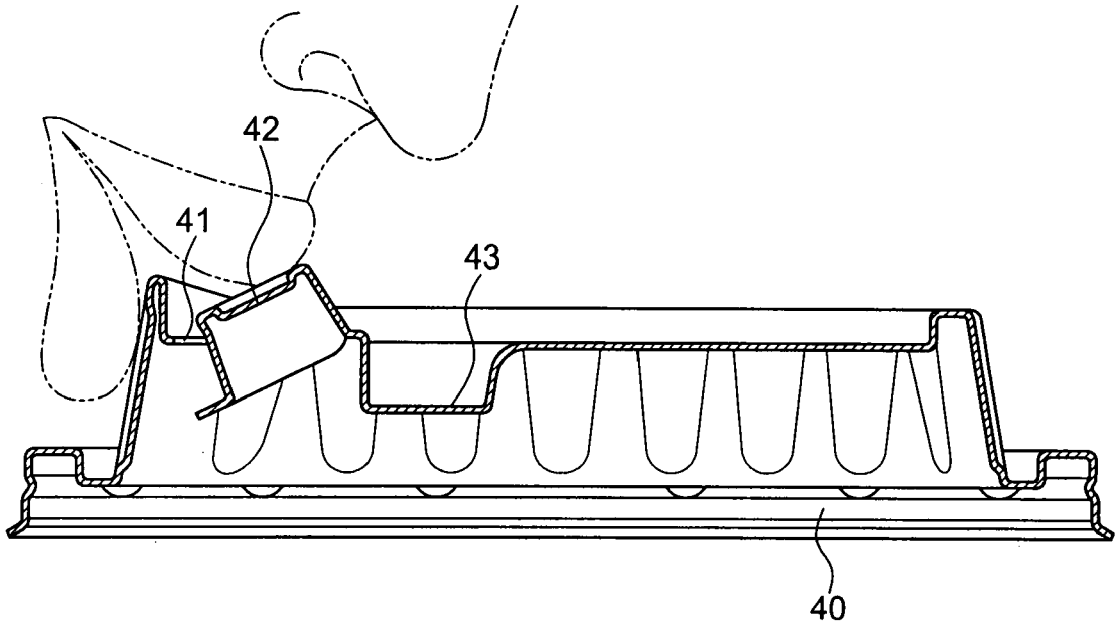
FIG.6 PRIOR ART
FIG. 6 is a cutaway view taken along the line 6-6 in FIG. 5.
Figure 7:
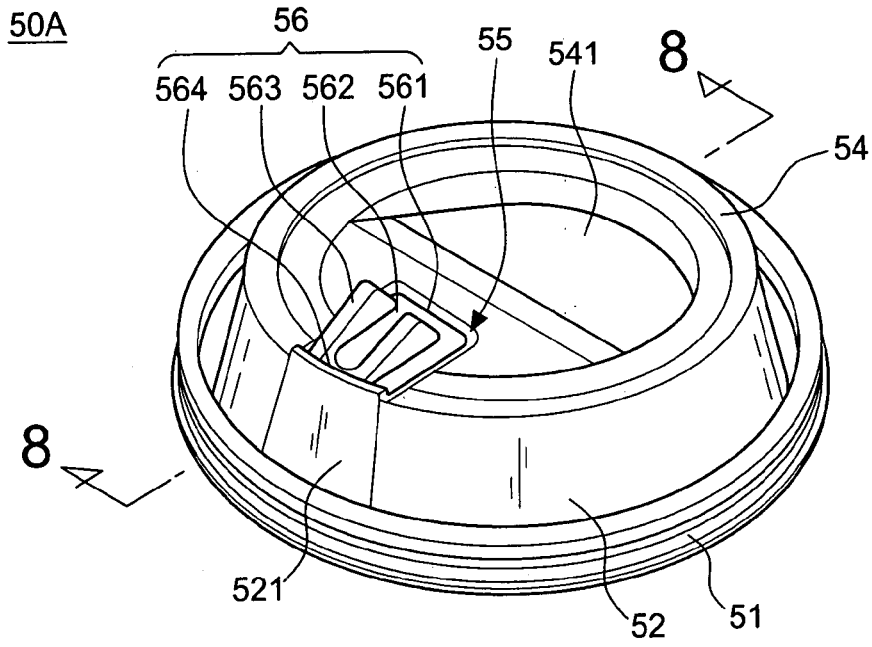
FIG. 7 is a perspective view of a cup lid in accordance with a first embodiment of the invention.
Figure 8:
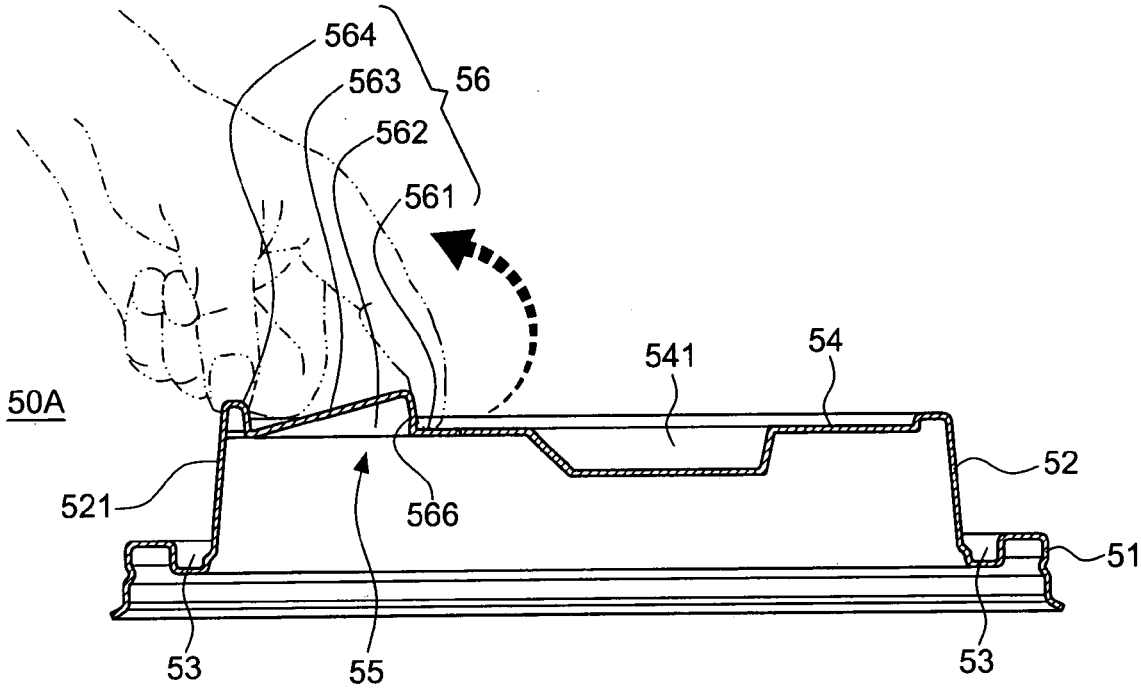
FIG. 8 is a cutaway view taken along the line 8-8 in FIG. 7.

Referring to FIGS. 7 and 8, a cup lid 50A in accordance with a first embodiment of the present invention is made of plastic material and integrally formed by an injection molding process. The cup lid 50A includes a lip portion 51 and a wall side 52. The lip portion 51 is formed in a ring shape with an opening directed downwards. The lip portion 51 is attachable to the opening of a drink cup (not shown). The wall side 52 is disposed atop the lip portion 51 in a ring shape. The wall side 52 and the lip portion 51 define an annular groove 53. The above-mentioned structure belongs to the prior art so that it won't be described more hereinafter.

Figure 9:
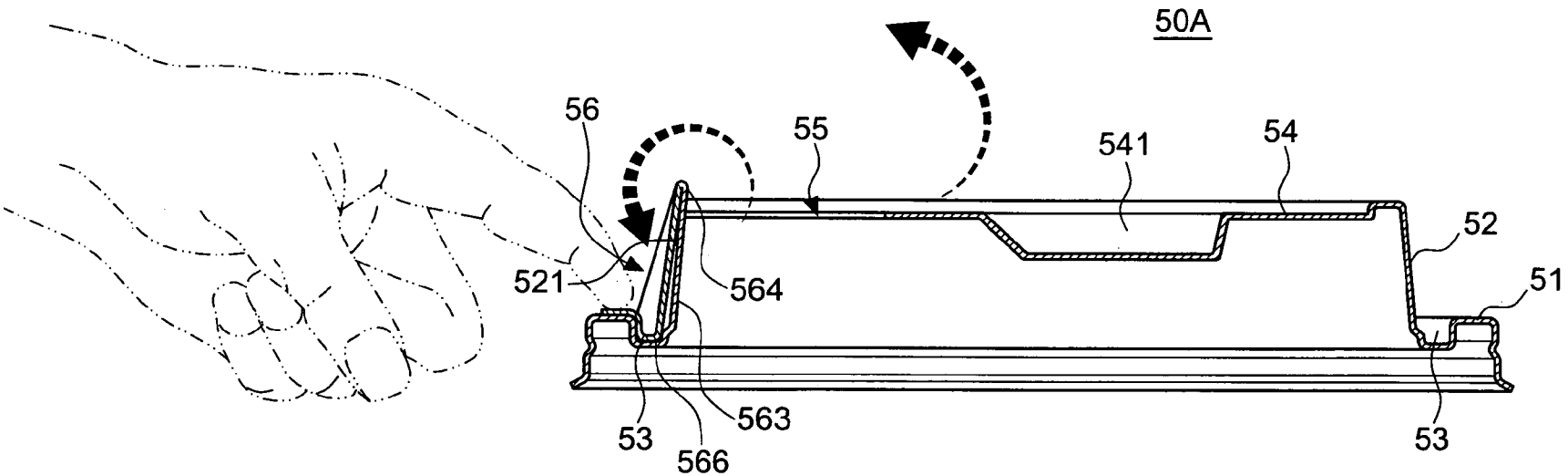
FIG. 9 is a schematic drawing of a cup lid in accordance with the first embodiment of the invention wherein the operation thereof is illustrated.

A top side 54 is formed at the top of the wall side 52. A tab 56 is disposed at a predetermined position of a sipping hole 55. The tab 56 includes a substantially ∩-shaped perforated portion 561 extending from the top rim of the wall side 52 to the center of the top side 54 and a turnover portion 562 formed after pulling off the ∩-shaped perforated portion 561. A raised inclined plane 563 is extended from the external side of the turnover portion 562 to the center. Meanwhile, a straight rib 564 is formed at the external side of the turnover portion 562 beyond the ∩-shaped perforated portion 561. The rib of the prior art is disposed at the rim of the cup lid 50A and formed in an arc shape. However, the arc-shaped rib causes an inconvenient turnover action. Thus, the rib in accordance with the invention is formed in a shape of the straight line. In this way, the turnover portion 562 may swivel on the straight rib 564. As shown in FIG. 8, a finger hooked on an end rim 566 of the raised inclined plane 563 is swiveled forward and downward at 270° (see FIG. 9) in such a manner that the end rim 566 of the raised inclined plane 563 is engaged into the annular groove 53 in place. Thus, the front side of the sipping hole 55 has a double-layer structure through which the drink must pass when the cup is brought in an inclined position for drinking. Meanwhile, the sipping hole 55 can serve as heat conduction area. Generally, the mouth of the drinker easily becomes scalded at this place. However, the double-layered structure formed after pulling off the tab 56 may protect the mouth from a burn caused by the heat conduction action of hot liquid when drinking from the sipping hole 55.

Unlike the prior art with an arc shape, the wall side 52 includes a flat portion 521 formed at a place where the turnover portion 562 is positioned (see FIG. 7). In this way, a tight contact of the turnover portion 562 is easily ensured. Moreover, the top side 54 includes an inclined groove 541 at a side opposing to the tab 56 such that the inclined groove 541 won't be in contact with the nose of the drinker in drinking.

Unlike the conventional tab that exposes the sipping hole by a pushing action in a backward direction, the tab 56 in accordance with above-mentioned embodiment of the invention is hooked by a finger of the user in a forward direction for removal. Therefore, the invention is more ergonomically designed. After turning the tab 56 at 270°, it may serve as a second external layer for the wall side 52, thereby protecting the mouth of the drinker from scald caused by the action of hot liquid. Accordingly, a double effect of the aforementioned embodiment can be achieved.

Figure 10:
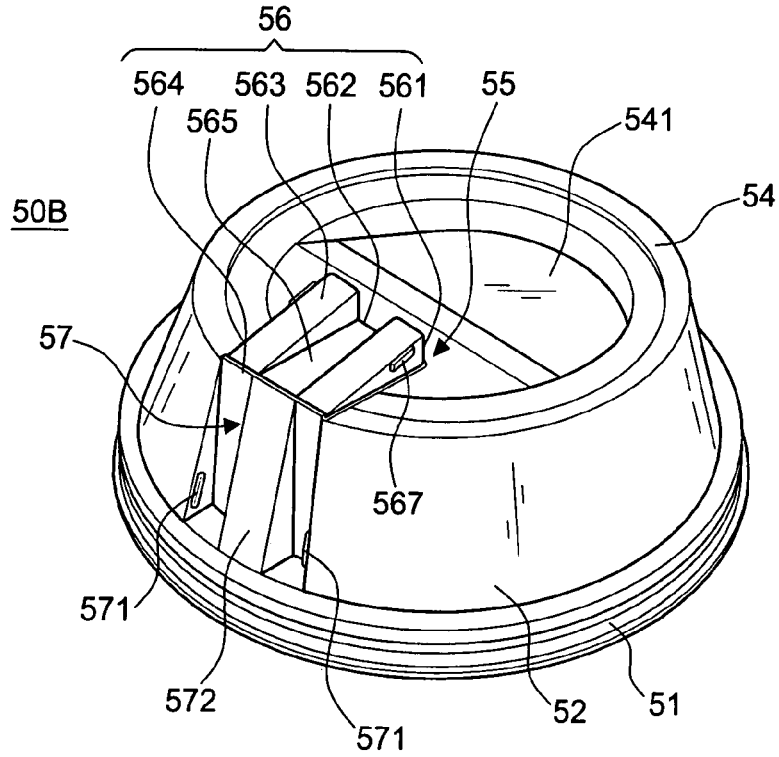
FIG. 10 is a perspective view of a cup lid in accordance with a second embodiment of the invention.
Figure 11:
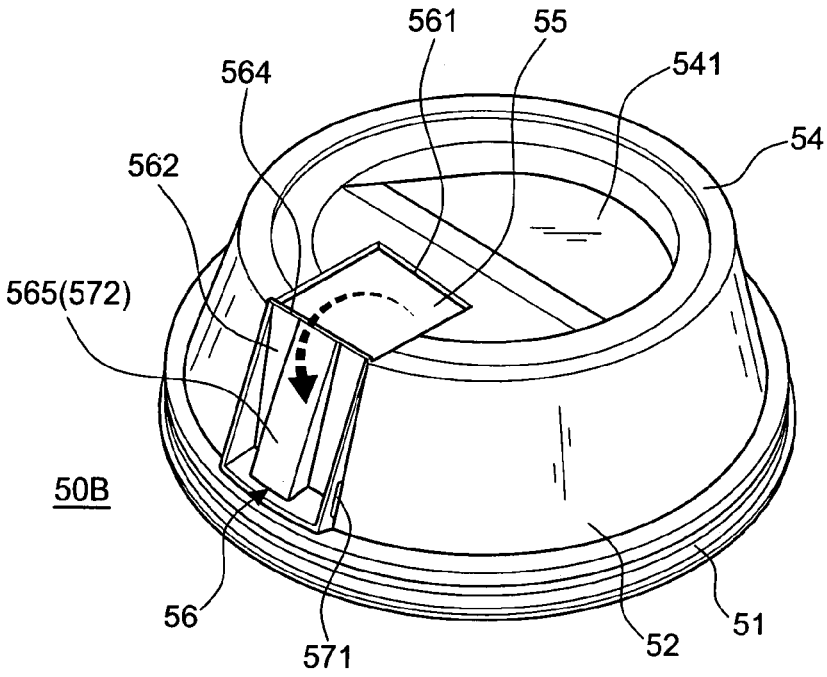
FIG. 11 is a schematic drawing of a cup lid in accordance with the second embodiment of the invention wherein the operation thereof is illustrated.

FIGS. 10 and 11 show a second embodiment of the invention. The cup lid 50B substantially corresponds to that of the first embodiment. The similar components are marked with the same reference signs. The difference lies in that both sides of the raised inclined plane 563 of the turnover portion 562 are provided with a protrusion 567, respectively. Meanwhile, a cavity 57 is formed at a place where the turnover portion 562 is swiveled such that the turnover portion 562 can be received therein. Both side walls of the cavity 57 are respectively provided with a projection 571 corresponding to the protrusion 567 of the turnover portion 562. In this way, the turnover portion 562 may be locked within the cavity 57 by means that the projections 571 and the protrusions 567 are engaged to each other. Accordingly, the double-layered structure is created.

In accordance with the embodiment of the invention, the raised inclined plane 563 of the turnover portion 562 further includes a radial groove 565. Besides, a guide body 572 corresponding to the radial groove 565 is positioned in the cavity 57. In this way, the drink in the cup may be flowed into the guide body 572 when drinking from the sipping hole. Accordingly, a smooth flow of the drink and a convenient drinking action are ensured. The other features are the same to the previous embodiment so that no further descriptions thereto are given hereinafter.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A beverage cup lid with a pull back sipping hole closure, comprising:

a) a lip portion formed in a ring shape with an opening directed downwards, the lip portion being attachable to the opening of a drink cup;

b) a wall side disposed atop the lip portion in a ring shape, c) a top side formed at the top of the wall side, a tab being disposed at a predetermined position of a sipping hole, the tab having a substantially ∩-shaped perforated portion extending from the top rim of the wall side to the center of the top side and a turnover portion formed after pulling off the ∩-shaped perforated portion, a raised inclined plane being extended from the external side to the center, a straight rib being formed at the external side of the turnover portion beyond the ∩-shaped perforated portion so that the turnover portion may be swiveled forward and downward at 270°, both sides of the raised inclined plane being provided with a protrusion, respectively; and d) a cavity formed at a place where the turnover portion is swiveled such that the turnover portion is received therein, both side walls of the cavity being respectively provided with a projection corresponding to the protrusion of the turnover portion such that the turnover portion is locked within the cavity by the projections and the protrusions engaging each other, thereby forming a double layered structure.

2. The beverage cup lid as recited in claim 1, wherein the raised inclined plane of the turnover portion further includes a radial groove, and wherein a guide body corresponding to the radial groove is positioned in the cavity.

3. The beverage cup lid as recited in claim 1, wherein the top side includes an inclined groove at a side opposing to the tab.

* * * * *